US010895436B2

(12) United States Patent
Ross

(10) Patent No.: US 10,895,436 B2
(45) Date of Patent: Jan. 19, 2021

(54) CLAMPING SYSTEM FOR GUN SIGHT

(71) Applicant: Raytheon Canada Limited, Ottawa (CA)

(72) Inventor: Brien D. Ross, Wyevale (CA)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/086,134

(22) PCT Filed: Dec. 1, 2015

(86) PCT No.: PCT/CA2015/051253

§ 371 (c)(1),
(2) Date: Sep. 18, 2018

(87) PCT Pub. No.: WO2017/091882

PCT Pub. Date: Jun. 8, 2017

(65) Prior Publication Data

US 2019/0137221 A1 May 9, 2019

(51) Int. Cl.
*F41G 11/00* (2006.01)

(52) U.S. Cl.
CPC ..... *F41G 11/003* (2013.01); *F41G 11/004* (2013.01)

(58) Field of Classification Search
CPC ..... F41G 11/003
USPC ..... 42/124, 125, 127
See application file for complete search history.

(56) References Cited

U.S. PATENT DOCUMENTS 6,442,883 B1 9/2002 Waterman et al.
6,931,778 B1 * 8/2005 Nelson ..... F41G 1/35 42/120
7,370,449 B1 * 5/2008 Beckmann ..... F41G 11/003 24/542
7,562,485 B2 * 7/2009 Newhall ..... F41G 11/003 42/124
8,769,859 B2 * 7/2014 Li ..... F41G 11/003 42/124
2003/0189146 A1 10/2003 Wooten et al.
2005/0241212 A1 11/2005 Swan
(Continued)

OTHER PUBLICATIONS

International Search Report for corresponding International Application No. PCT/CA2015/051253 dated Aug. 11, 2016.
(Continued)

*Primary Examiner* — Reginald S Tillman, Jr.
(74) *Attorney, Agent, or Firm* — Renner, Otto, Boisselle & Sklar, LLP

(57) ABSTRACT

A gun sight clamping system utilizes a resilient device and an over-center cam to attach a gun sight to the rail of a gun. The body of the clamping system is clamped to the rail using a clamping mechanism on one side of the assembly and a resilient device on the other side of the assembly. The resilient device operates in a direction parallel to the clamping direction. A cross bar connects the clamping mechanism to the resilient device and provides a means to squeeze the body of the mount to the rail. As the lever is closed, the cam drives the cross bar, pulling the clamping mechanism against the rail. The resilient device allows the cam to move to an over-center position wherein the unit resists loosening during operation. Once the over-center position is achieved, the spring force of the resilient device holds the cam in the closed position.

19 Claims, 18 Drawing Sheets

(56) References Cited

U.S. PATENT DOCUMENTS

| | | | | |
|---|---|---|---|---|
| 2010/0107467 | A1 | 5/2010 | Samson et al. | |
| 2011/0067287 | A1 * | 3/2011 | Collin | F41G 11/003 42/119 |

OTHER PUBLICATIONS

Written Opinion of the International Searching Authority for corresponding International Application No. PCT/CA2015/051253 dated Aug. 11, 2016.

International Preliminary Report on Patentability for corresponding International Application No. PCT/CA2015/051253 dated Jun. 5, 2018.

* cited by examiner

Fig. 2---Prior Art

Fig. 3--Prior Art

Open Position

CLAMPING SYSTEM FOR GUN SIGHT

This application is a national phase of International Application No. PCT/CA2015/051253 filed Dec. 1, 2015 and published in the English language, which is incorporated herein by reference.

BACKGROUND OF THE INVENTION

Field of the Invention

The invention is in the field of gun sights, and mounting systems for gun sights.

Description of the Related Art

Many mechanisms have been used to clamp a gun sight to the rail of a gun. Such mechanisms have been configured in a number of ways, each using a variety of different component parts. However, these configurations present shortcomings in the clamping process that render the mechanism less than fully effective in achieving its goal of maintaining the boresight accuracy of the gun. These prior configurations have a tendency to loosen from the vibration caused by the firing of the gun, which affects the precision of the gun sight and its boresight accuracy. Such configurations also present difficulties in making adjustments for varying rail widths caused by tolerance variations and differences in the rail design (i.e. Weaver rail versus Picatinny rail). There is a need in this field for a gun sight clamping system that addresses these shortcomings and offers the user the ability to quickly interchange sights, while still maintaining boresight accuracy. Prior art in this field has incorporated resilient devices but only in a direction perpendicular to the clamping direction for the purpose of making adjustments for varying rail width.

SUMMARY OF THE INVENTION

According to an aspect of the invention, a gun sight clamping system includes a body, a clamping bar, a cross bar engaging the body and the clamping bar, and a resilient device. The body and the clamping bar have respective longitudinal inner surfaces for engaging a gun rail in a hollow defined by the inner surfaces and an underside of the body. The resilient device provides a resilient force, in a direction transverse to an extent of the longitudinal inner surfaces, and from one of the longitudinal inner surfaces to the other longitudinal inner surface, that controls a clamping force by the clamping bar and the body, on the gun rail.

According to another aspect of the invention, the cross bar includes a dovetail protrusion wherein the body and the clamping bar have respective longitudinal inner surfaces for engaging a gun rail in a hollow defined by the inner surfaces and an underside of the body. The underside of the body includes a dovetail groove that mates with the dovetail protrusion of the cross bar as the cross bar engages the body and the clamping bar.

According to yet another aspect of the invention, a method for attaching a body of a sight mount to a rail of a gun includes securing the body to the rail, wherein both the body and the rail are positioned in the transverse direction between a clamping device and a resilient device. The magnitude of the force imparted to the resilient device is created by a cam on the lever with an over-center position. The resilient device maintains a substantially constant clamping force between the body and the rail wherein the resilient device is retained between the body and an adjustment nut.

The magnitude of the force imparted to the resilient device may be controlled by one or more levers, each with an over-center cam that engages one or more cross bars, which squeeze the assembly together, compressing the resilient device, as each lever is rotated from the open to the closed position.

The underside of the body may include one or more dovetail grooves that mate with one or more dovetail protrusions in one or more cross bars, as the cross bars engage the body and the clamping bar.

According to even another aspect of the invention, one or more resilient devices are retained on one or more cross bars by one or more threaded nuts.

According to an embodiment of the device of any other paragraph(s), the rail is engaged by one or more clamping bars.

In one embodiment, the resilient device includes one or more Belleville washers stacked adjacent to each other in series.

In another embodiment, the one or more resilient devices are retained on one or more cross bars by one or more wing nuts.

In one embodiment, the lever resides on the same side of the rail as one or more clamping bars.

In another embodiment, one or more levers reside on the same side of the rail as the body.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A gun sight clamping system utilizes a resilient device and an over-center cam to attach a gun sight to the rail of a gun. The body of the clamping system is clamped to the rail using a clamping mechanism on one side of the assembly and a resilient device on the other side of the assembly. The resilient device operates in a direction parallel to the clamping direction. A cross bar connects the clamping mechanism to the resilient device and provides a means to squeeze the body of the mount to the rail. As the lever is closed, the cam drives the cross bar, pulling the clamping mechanism against the rail. The resilient device allows the cam to move to an over-center position wherein the unit resists loosening during operation. Once the over-center position is achieved, the spring force of the resilient device holds the cam in the closed position.

Figure 1:
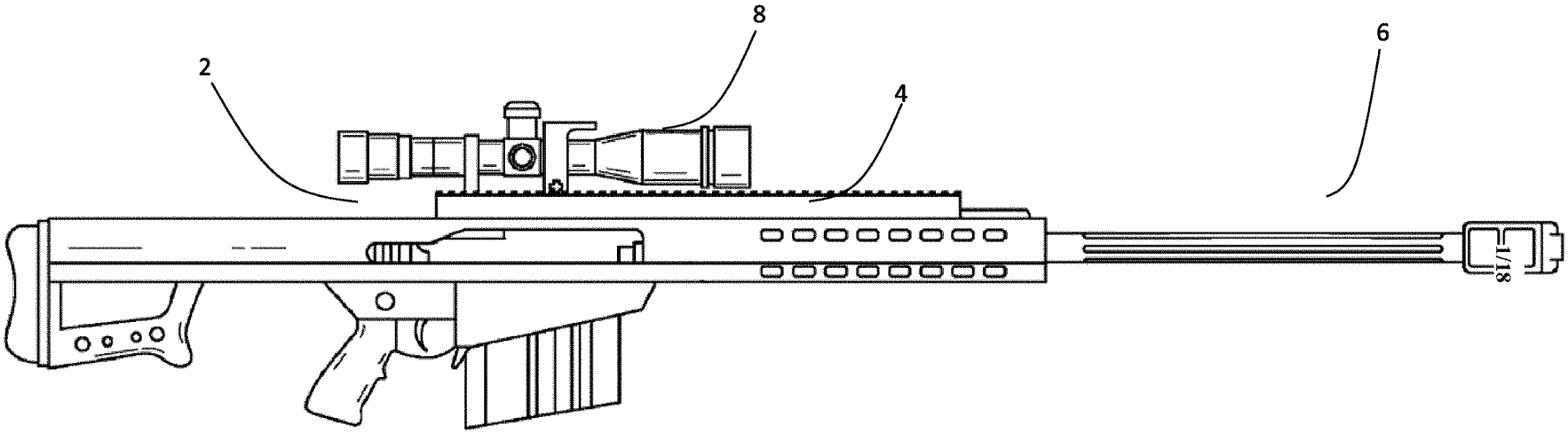
FIG. 1 is a side view of a gun with a sight mounted to the gun.

Referring initially to FIG. 1, a gun sight clamping system 2 is mounted to a rail 4 of a gun 6, for the purpose of using a gun sight 8 in conjunction with the gun 6. The gun sight clamping system is an adapter that allows for the gun sight 8 to be attached to the rail 4. The gun sight 8 is used to provide the user of the gun 6 with precision instrumentation for the purpose of targeting objects.

Figure 2:
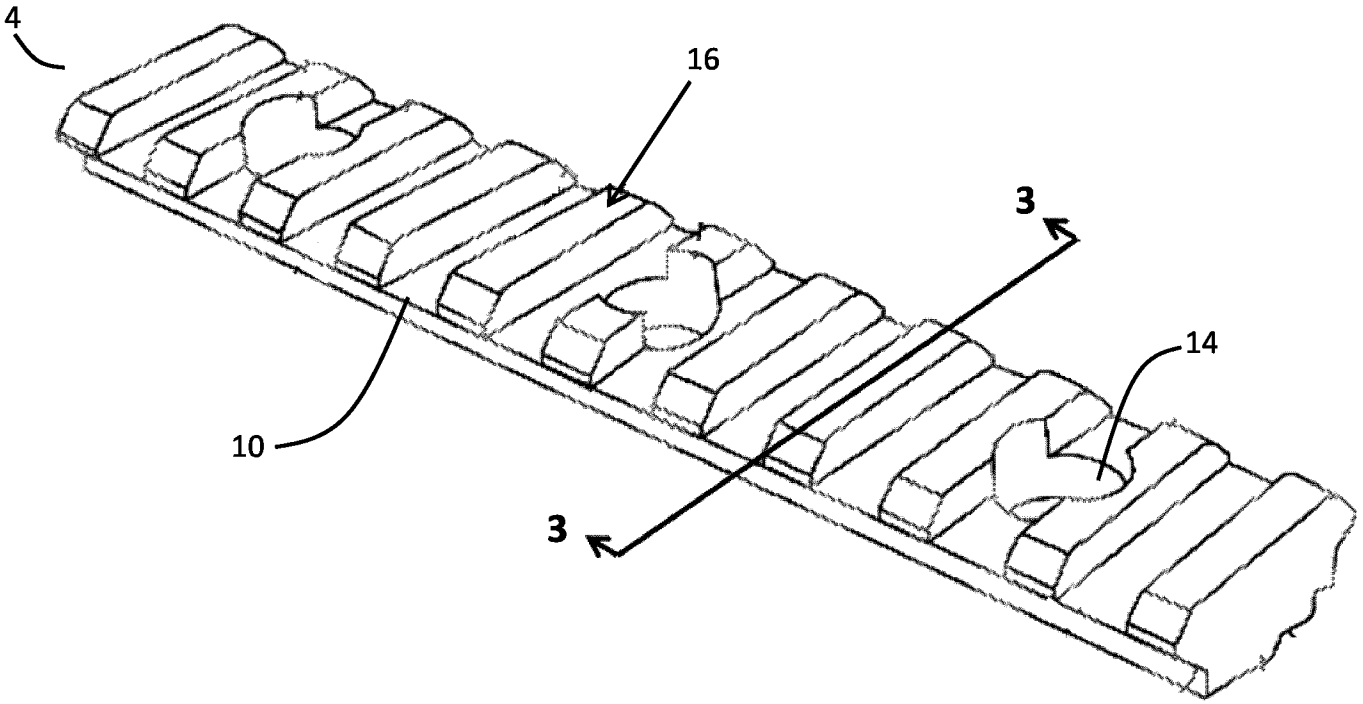
FIG. 2 is a perspective view of a prior art rail.
Figure 3:
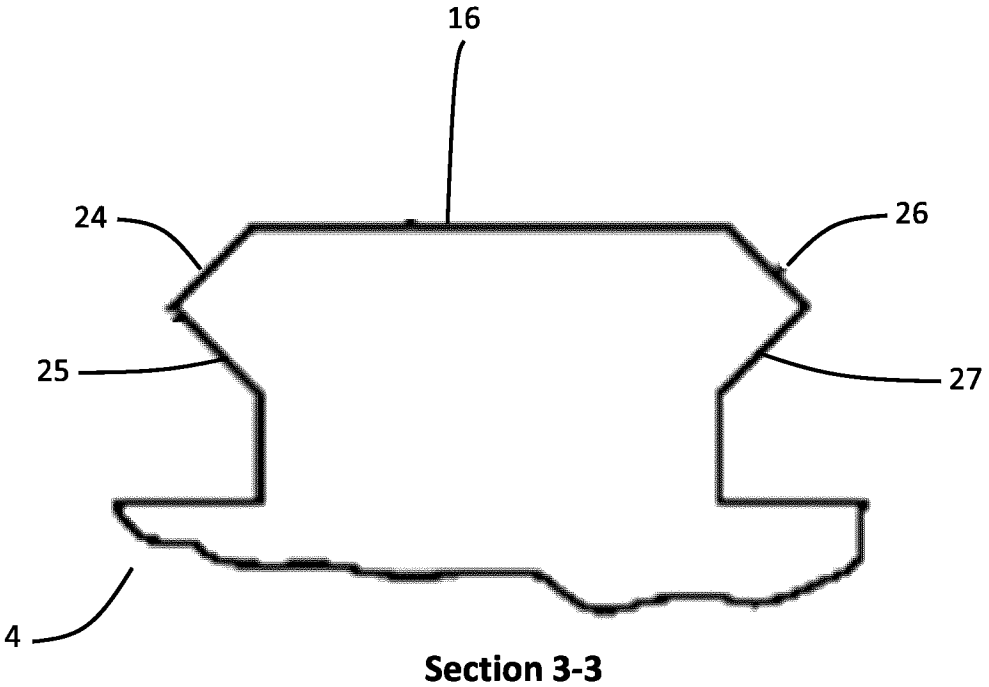
FIG. 3 is a longitudinal cross-section view of the rail of FIG. 2.
Figure 4:
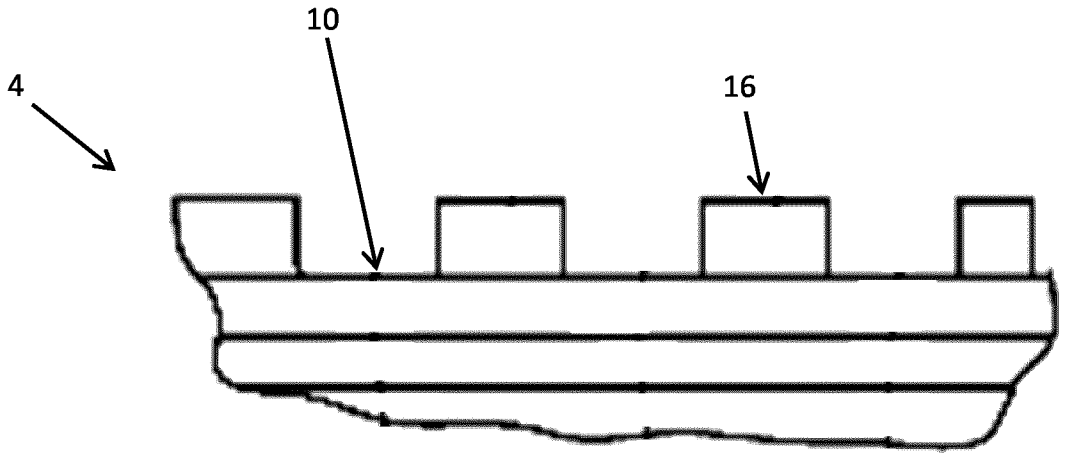
FIG. 4 is a transverse side view of the rail of FIG. 2.
Figure 6:
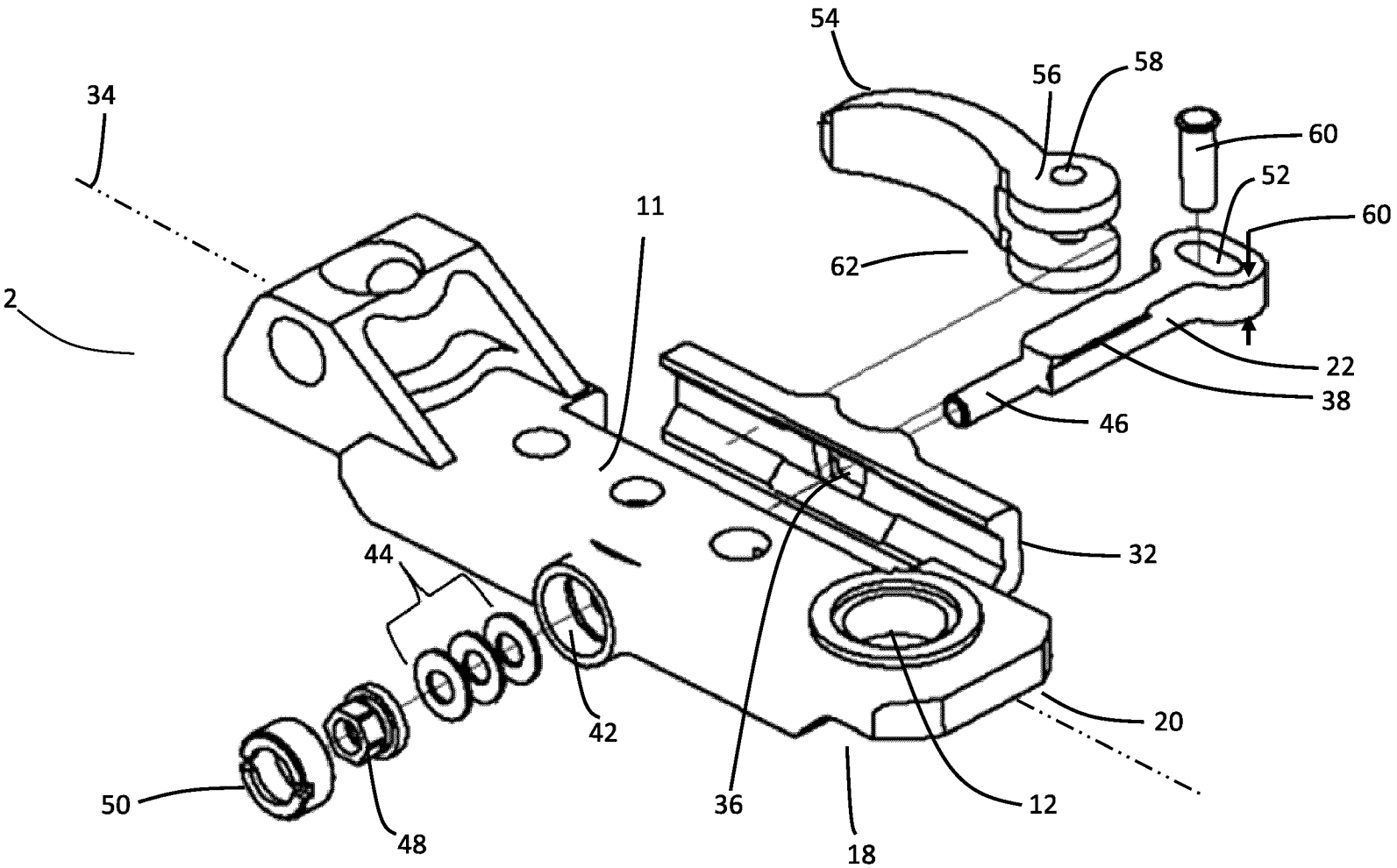
FIG. 6 is an exploded view of the gun sight clamping system of FIG. 1.

With reference in addition to FIGS. 2-4, the gun sight clamping system 2 attaches to the gun 6 by engaging a transverse groove 10 of the rail 4, tightly squeezing the exterior geometry of the rail 4 to provide a stable horizontal platform for which to mount the gun sight 8. On the top face 11 (FIG. 6) of the gun clamping system 2 is a mounting hole 12 (FIG. 6). Once the gun clamping system is mounted to the rail, the gun sight may be inserted into the mounting hole 12. This secures the gun sight 8 while providing the user the benefit of rapid interchangeability, if desired.

FIGS. 2-4 show further details of the prior art rail 4. The top of the rail 4 has transverse ridges 16, detailed in FIG. 3, that run parallel to the clamp direction. When assembled, the underside 18 (FIG. 6) of a body 20 (FIG. 6) of the system 2 (FIG. 1) rests atop these ridges 16. Between the transverse ridges 16 are transverse grooves 10, detailed in FIG. 4, through which a cross bar 22 (FIG. 6) of the gun sight clamping system 2 passes, as described further below.

Figure 5:
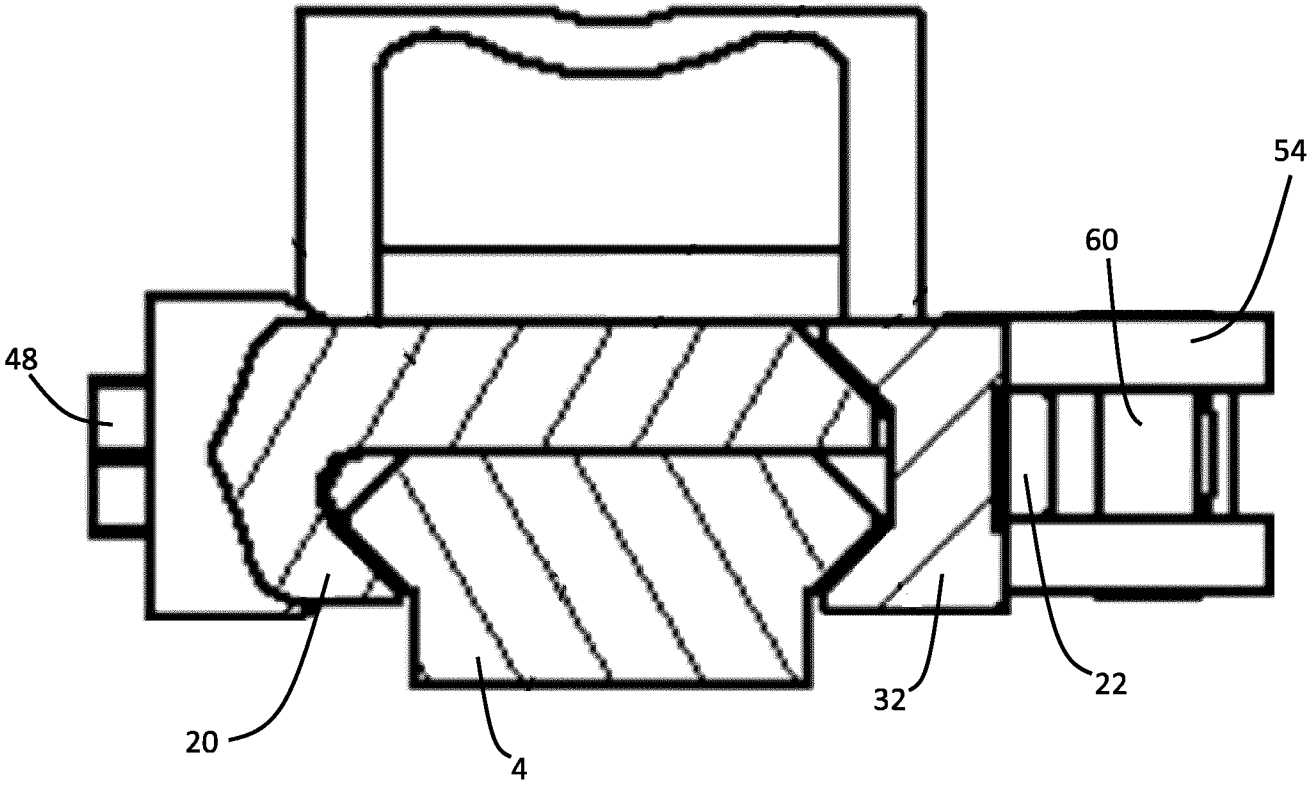
FIG. 5 is a plan partial-cutaway view of the gun clamping system assembled to a rail of a gun.
Figure 7:
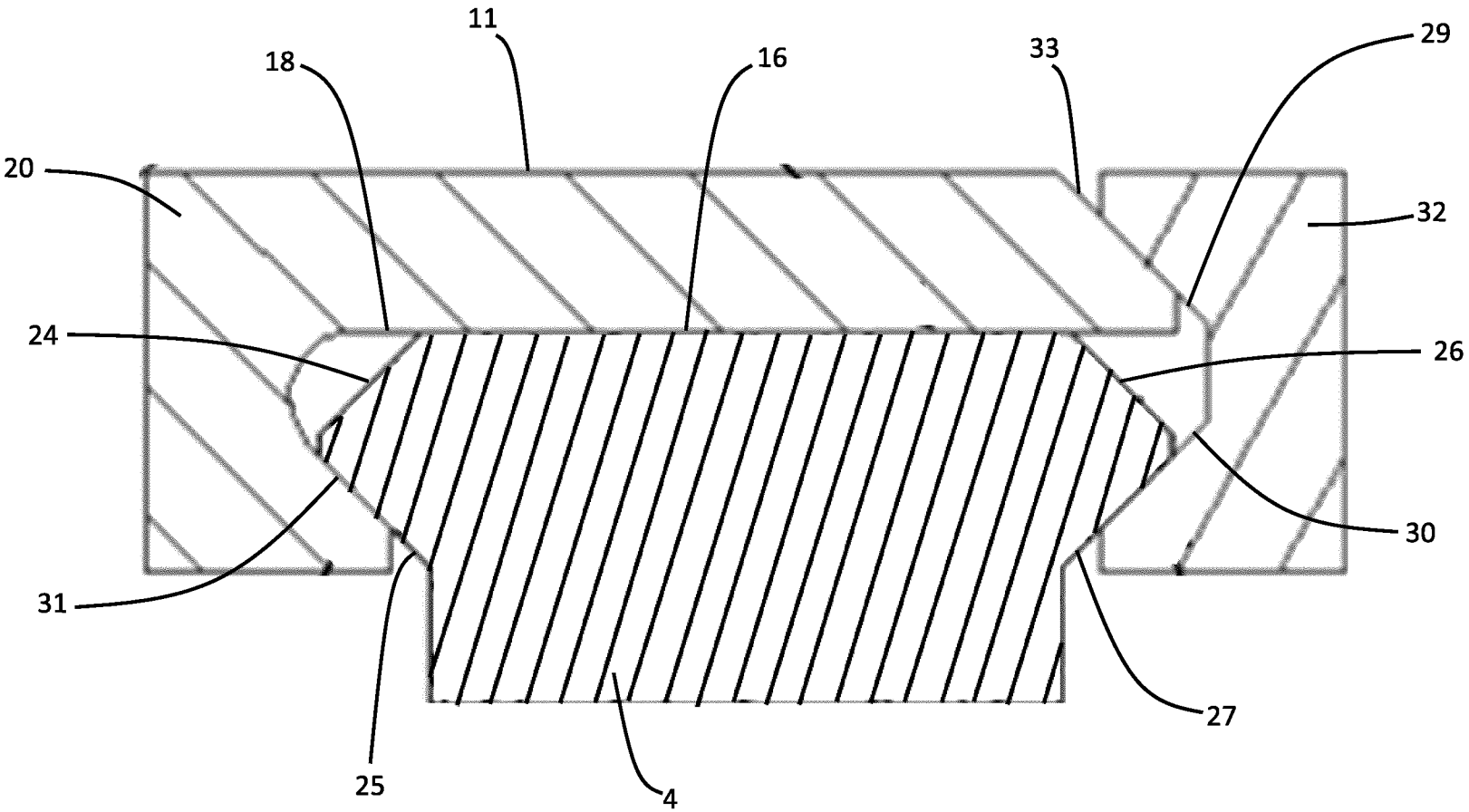
FIG. 7 is a cross-section view showing the mated assembly of the body, rail, and clamping bar.
Figure 8:
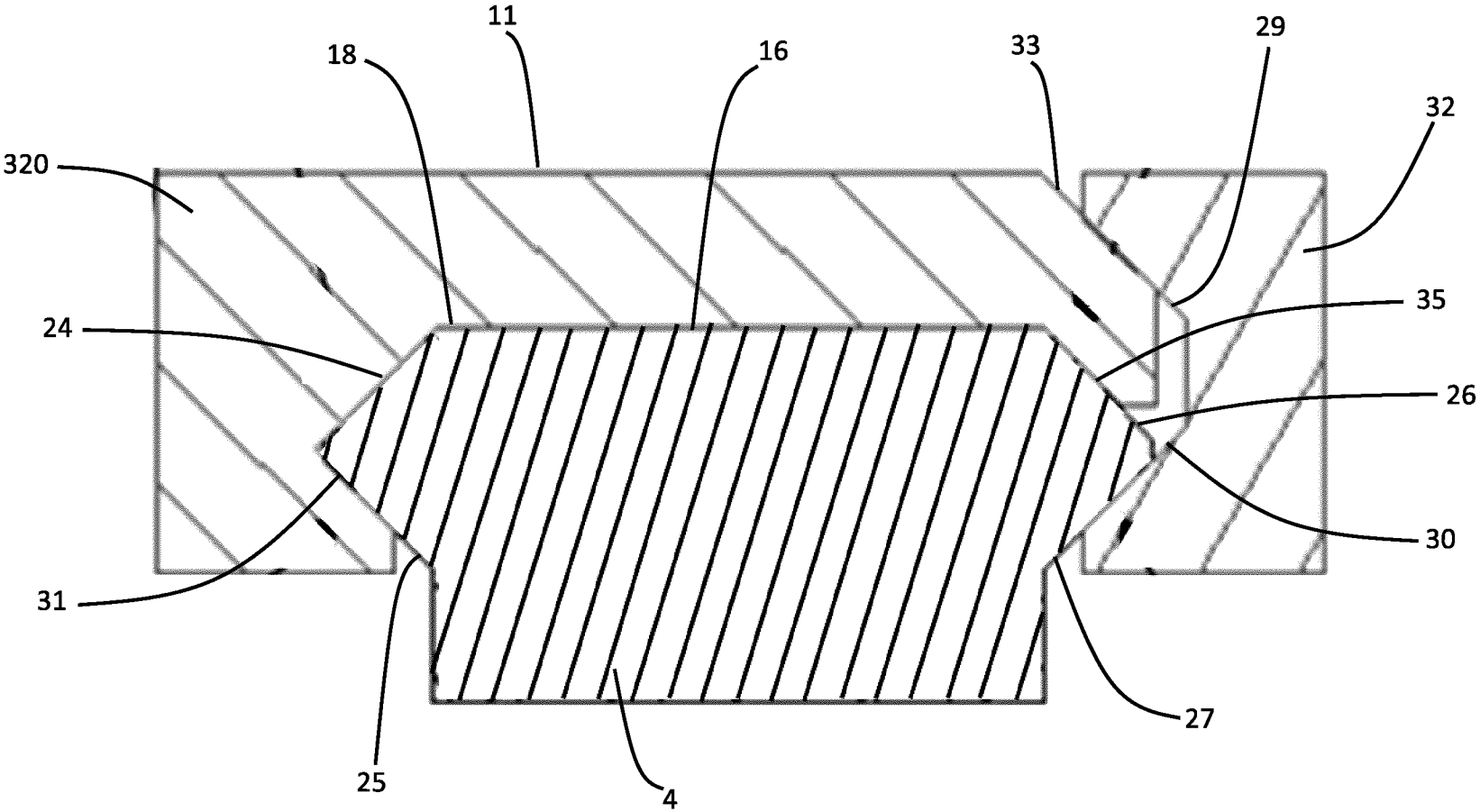
FIG. 8 is a cross-section view of an alternate embodiment in which the body has an additional lower angled surface to mate with one of the upper angled surfaces of the rail.

The gun clamping system 2 assembled to the rail of a gun is illustrated in FIG. 5 while the components of the gun clamping system 2 are represented in an exploded view in FIG. 6. To mount the gun clamping system 2 to the rail 4, the body 20 of the gun clamping system 2 engages the rail 4 (FIG. 2) of the gun 6 (FIG. 1). Specifically, the underside 18 of the body 20 engages the transverse ridges 16 of the rail 4 and the lower angled surface 31 (FIG. 7) of the body 20 engages the lower angled surface 25 (FIG. 7) of the rail 4. The lower angled surface 30 (FIG. 7) of the clamping bar 32 locates on the transversely opposed lower angled surface 27 (FIG. 7) of the rail 4. The upper angled surface 29 (FIG. 7) of the clamping bar 32 engages the upper angled surface 33 (FIG. 7) of the body 20. In another embodiment, represented in FIG. 8, the body 320 has an additional lower angled surface 35 that is transversely opposed to both the upper angled surface 24 and lower angled surface 31, that engages the upper angled surface 26 of the rail 4.

Figure 9:
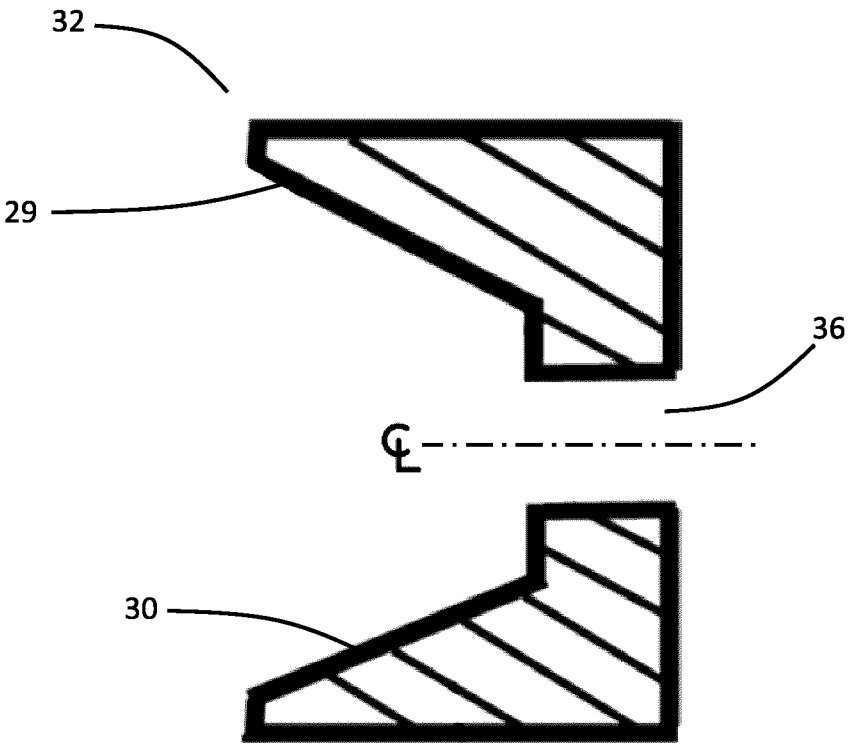
FIG. 9 is a cross-section view of the center of the clamping bar.

The cross bar 22 slides through the hole 36 (FIG. 9) of the clamping bar 32, into one of the transverse grooves 10 of the rail 4. As the cross bar 22 slides through a transverse groove 10 of the rail 4, the dovetail protrusion 38 shown in FIG. 10 of the cross bar 22 simultaneously engages a mating dovetail groove 40, detailed in FIG. 11, on the underside 18 of the body 20. This engagement maintains the position of the clamping bar 32 relative to the body 20.

The cross bar 22 emerges from a hole 42 (FIG. 6) of the body 20, on the side of the rail 4 opposite where the cross bar 22 initially enters. A resilient device 44 then proceeds over the protrusion 46 of the cross bar 22 and is retained on the protrusion 46 by an adjustment nut 48 that threads into the mating threads of the protrusion 46. In one embodiment, depicted in FIG. 6, the resilient device 44 is a stack of Belleville washers. Alternatively, the resilient device may be other types of devices, such as coil springs or disk washers, for example.

The adjustment nut 48 is a threaded fastener with female threads and a hexagonal head, that attaches onto mating male threads of the protrusion 46. This nut 48 can be threaded in and out to adjust the tension on the rail 4, for the purpose of accommodating varying rail 4 widths when the clamping system 2 is interchanged between different types of rail 4 platforms. A tool may be used in order to tighten the adjustment nut 48 to the appropriate torque. Also present in this embodiment is a retainer 50 that fits over and protects the hexagonal flats of the adjustment nut 48 from damage.

Figure 10:
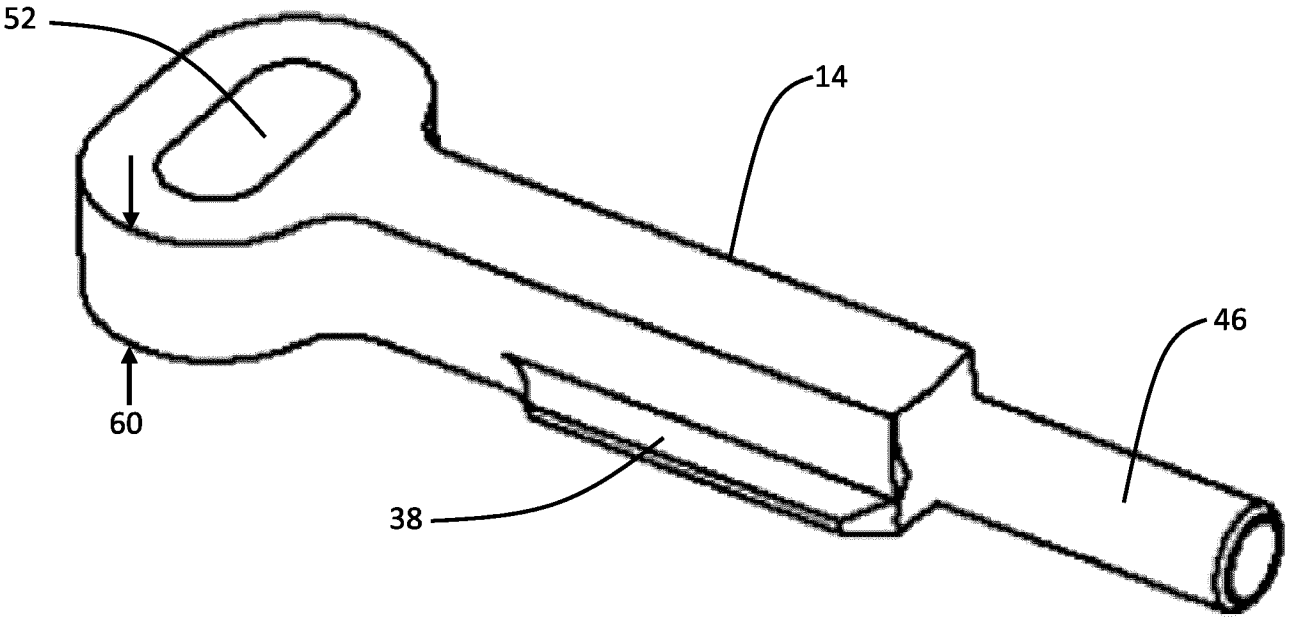
FIG. 10 is an oblique view of the cross bar and its dovetail feature of the system of FIG. 6.
Figure 11:
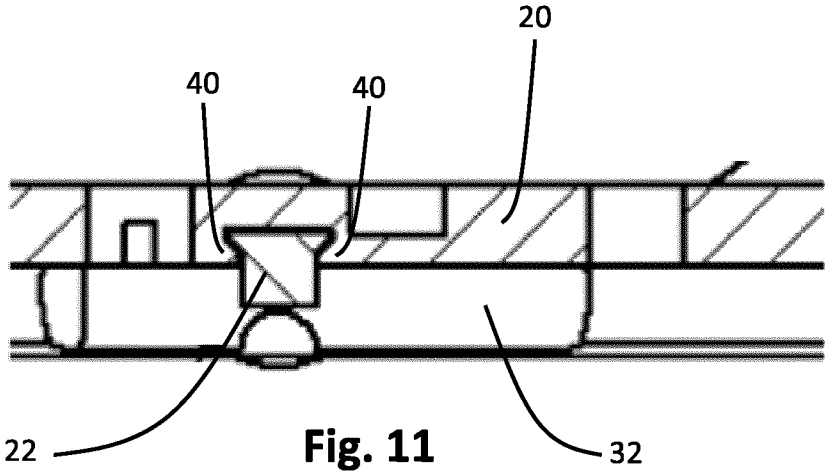
FIG. 11 is a cross-section view of parts of the system of FIG. 6, showing the cross bar engaged in the body and the clamping bar.

Referring to FIGS. 6 and 10, the end of the cross bar 22, opposite the protrusion 46, is a wider section of material with an oval-shaped or racetrack-shaped hole 52. A lever 54, with two circular prongs 56 and a collinear hole 58 in each prong 56, slides over the thickness 60 of the cross bar 22 such that there is one prong 56 on each side of the cross bar 22, above and below the cross bar 22. In doing this, the hole 52 of the cross bar 22 is adjusted to align with the collinear holes 58 of the lever 54. A pin 60 is inserted into the collinear holes 52 and 58. This connects the cross bar 22 to the lever 54.

Figure 12:
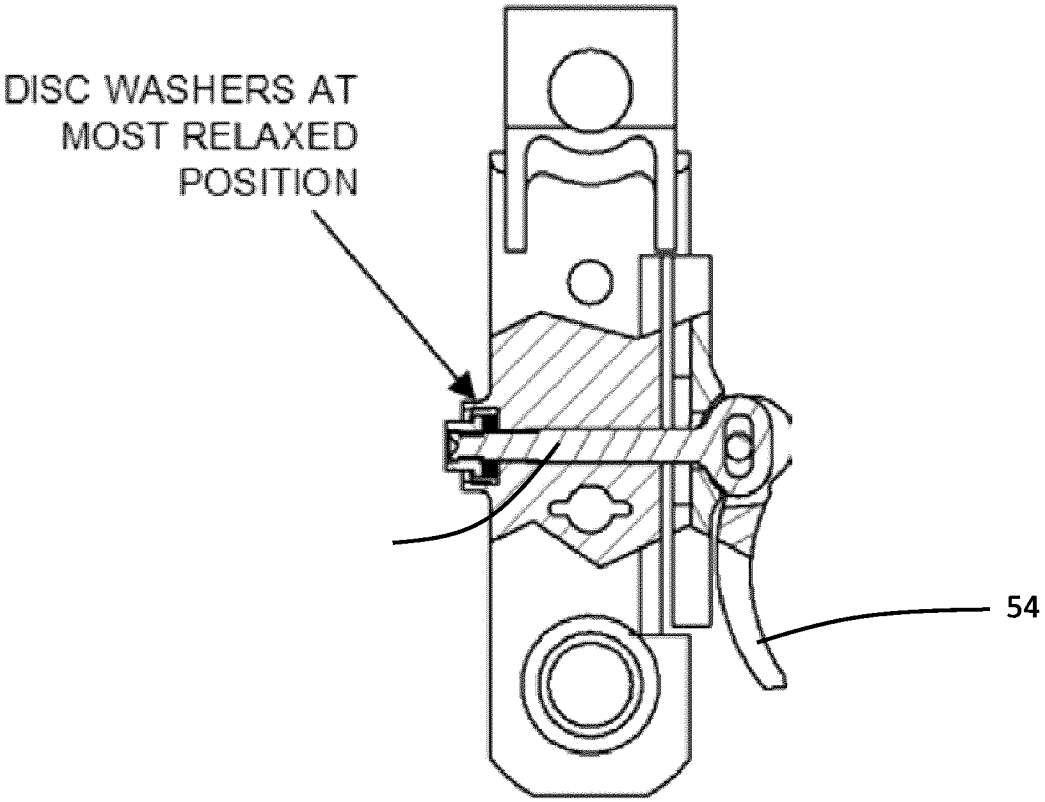
FIG. 12 is a plan partial-cutaway view of the gun sight clamping system of FIG. 6 in the open position on the rail.
Figure 13:
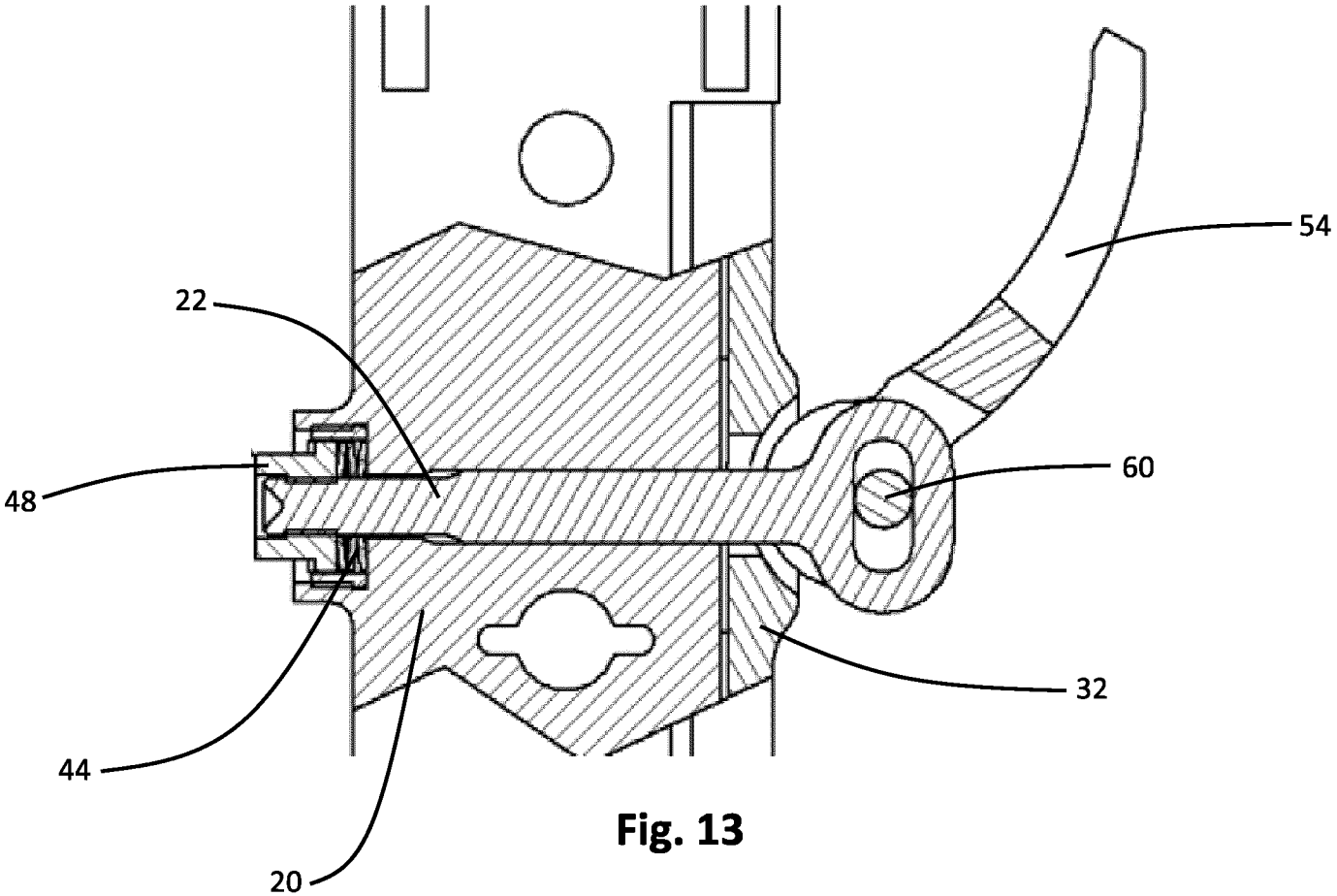
FIG. 13 is a cross-section view of the cross bar engaging the body and the clamping bar of the system of FIG. 6, with the lever in the intermediate clamping position.
Figure 14:
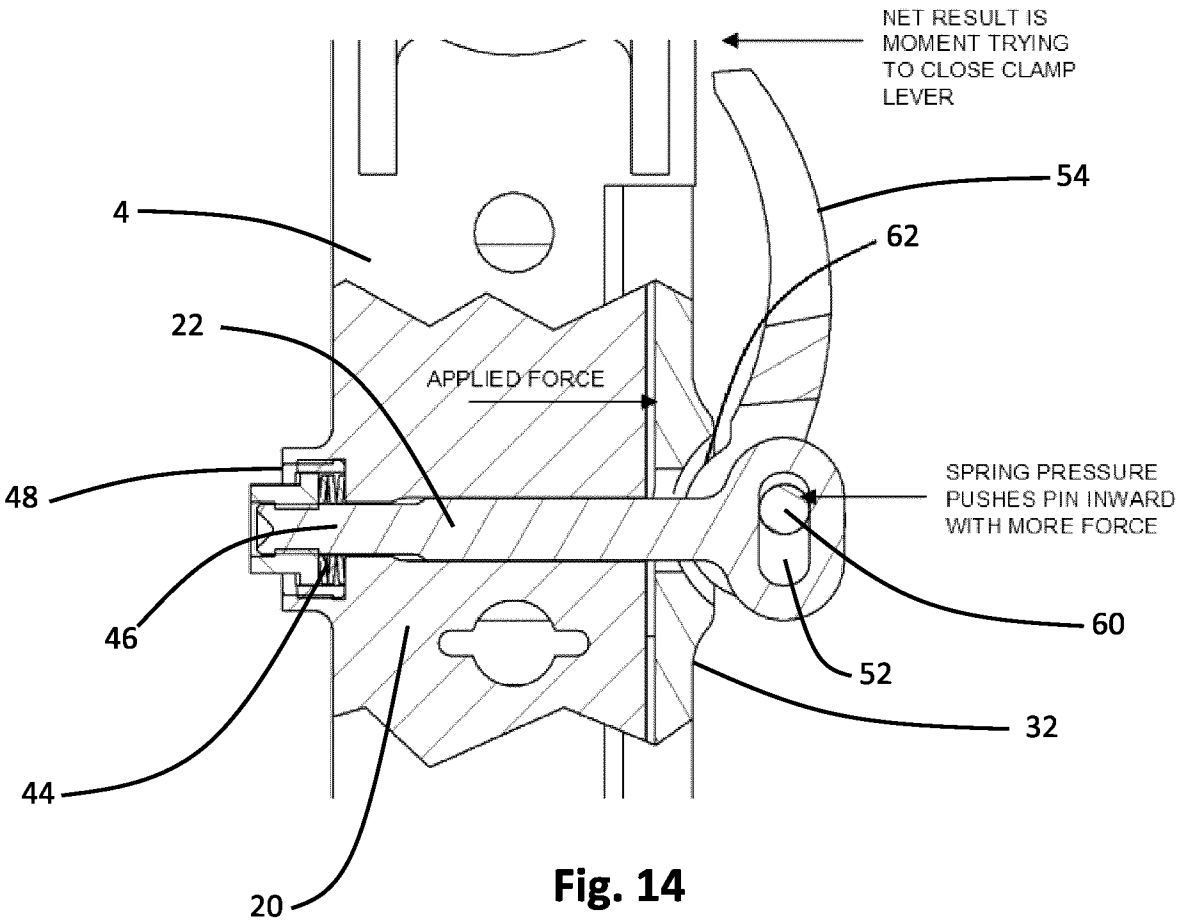
FIG. 14 is a cross-section view of the gun sight clamping system of FIG. 6 in the closed position on the rail, with a depiction of the forces and bending moments acting on the clamping system.

As depicted in FIG. 12-14, the lever 54 can rotate approximately 180°. In FIG. 12, the lever 54 is in the open position and the resilient device 44 is in its most relaxed position. As the lever 54 closes, it reaches an intermediate position, shown in FIG. 13, where the resilient device 44 is placed in maximum compression. The cross bar 22 is driven by a cam 62 that is included as part of the lever 54. Once the lever is rotated beyond this intermediate position, it reaches an over-center position where the resilient device 44 is placed in tension, shown in FIG. 14. This pulls together the mating surfaces of the body 20, rail 4, and clamping bar 32, and places a substantially continuous tension force on the lever 46 such that it remains in the closed position.

A force applied to the lever 54 in the opening direction, whether a manual force or a vibratory force realized while shooting the gun 6 (FIG. 1), is counteracted by a net moment on the lever, depicted in FIG. 14. This net moment is created by the resilient device 44 and forces the lever 54 to close even tighter. Because of this over-center design, no requirement exists for a separate locking mechanism to maintain closure of the lever 54. Once the over-center position is achieved, the spring force of the resilient device 44 holds the cam 62 in the closed position. Because of this strong spring action, the clamping system cannot loosen under vibratory conditions, which commonly occurs as a result of repetitive gunfire.

Figure 15:
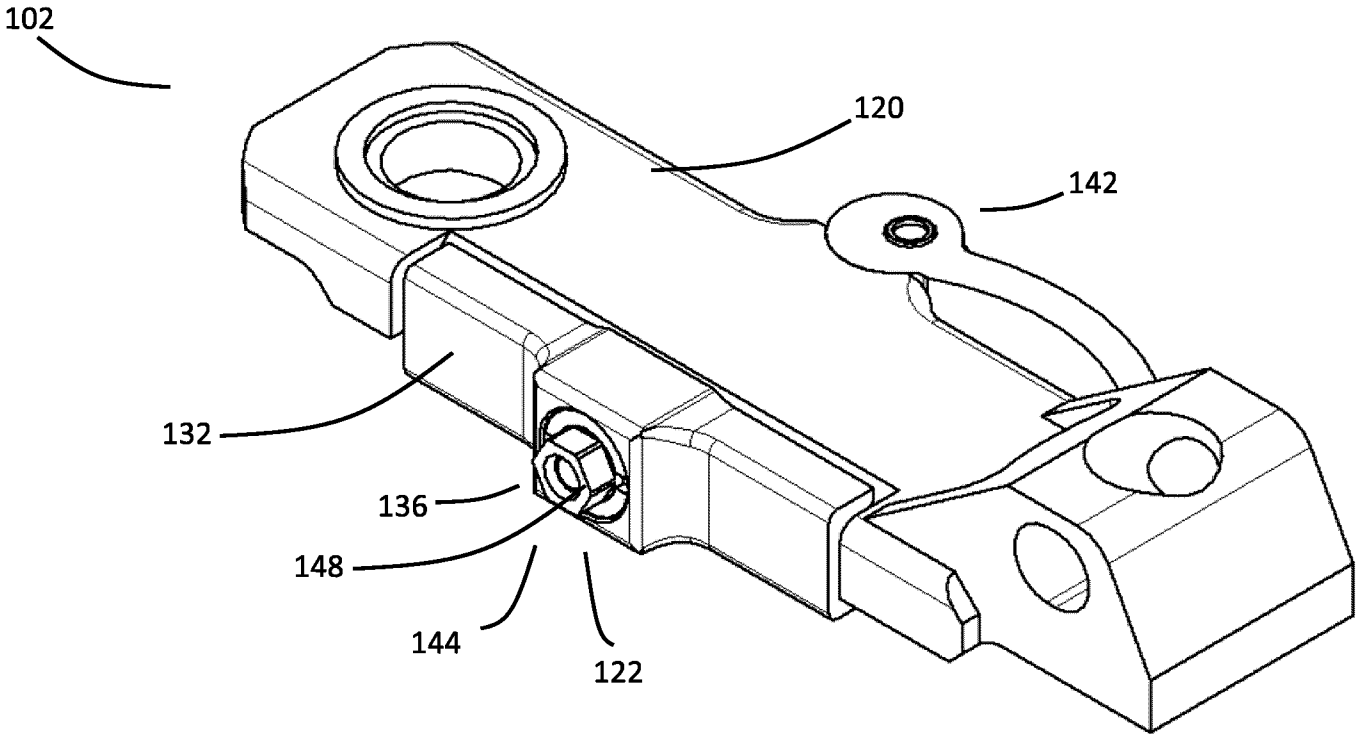
FIG. 15 is a perspective view of an alternate embodiment gun sight clamping system in which the cross bar is reversed so that the lever is adjacent to the body, and the adjustment nut is adjacent to the clamping bar.

FIG. 15 shows an alternate embodiment system 102 where a cross bar 122, which may be identical to the cross bar 22 (FIG. 6), is inserted into the rail 4 (FIG. 2) from the same side that the body 120 engages the rail 4, opposite the clamping bar 132. The cross bar 122 slides through the hole 142 of the body 120, into a transverse groove 10 (FIG. 2) of the rail 4. The cross bar 122 emerges from the mounting hole 136 of the clamping bar 132, on the side of the rail 4 opposite its initial entry, where resilient device 144 engages the protrusion 146 of the cross bar 122. In this embodiment, the adjustment nut 148, which retains the resilient device 144 on the cross bar 122, is adjacent to the clamping bar 132. Some elements in FIG. 15 that are not described are similar to those of the system 2 (FIG. 6).

Figure 16:
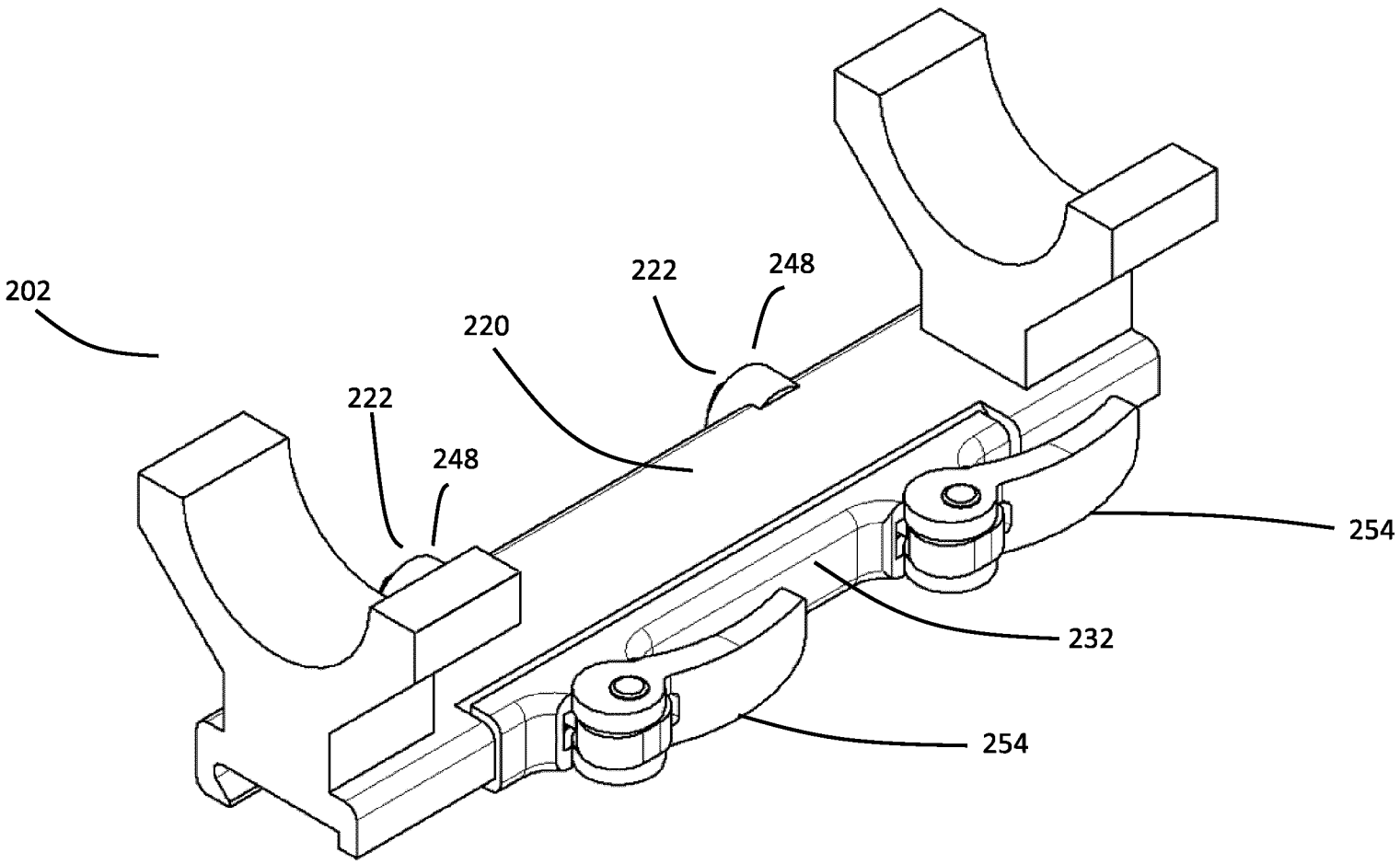
FIG. 16 is a perspective view of an alternate embodiment gun sight clamping system with a long clamping bar that requires multiple lever assemblies.

In another embodiment, a system 202 depicted in FIG. 16, two cross bars 222, two levers 254, two adjustment nuts 248, and two resilient devices 244 are used in conjunction with a single long clamping bar 232 and a modified body 220. Here, to make an adjustment for varying rail widths between guns, both adjustment nuts 248 must be tightened or loosened accordingly. This configuration can be used where a longer clamping bar 232 is desirable or necessary, such as to support a longer gun sight Some elements in FIG. 16 that are not described are similar to those of the system 2 (FIG. 6).

Figure 17:
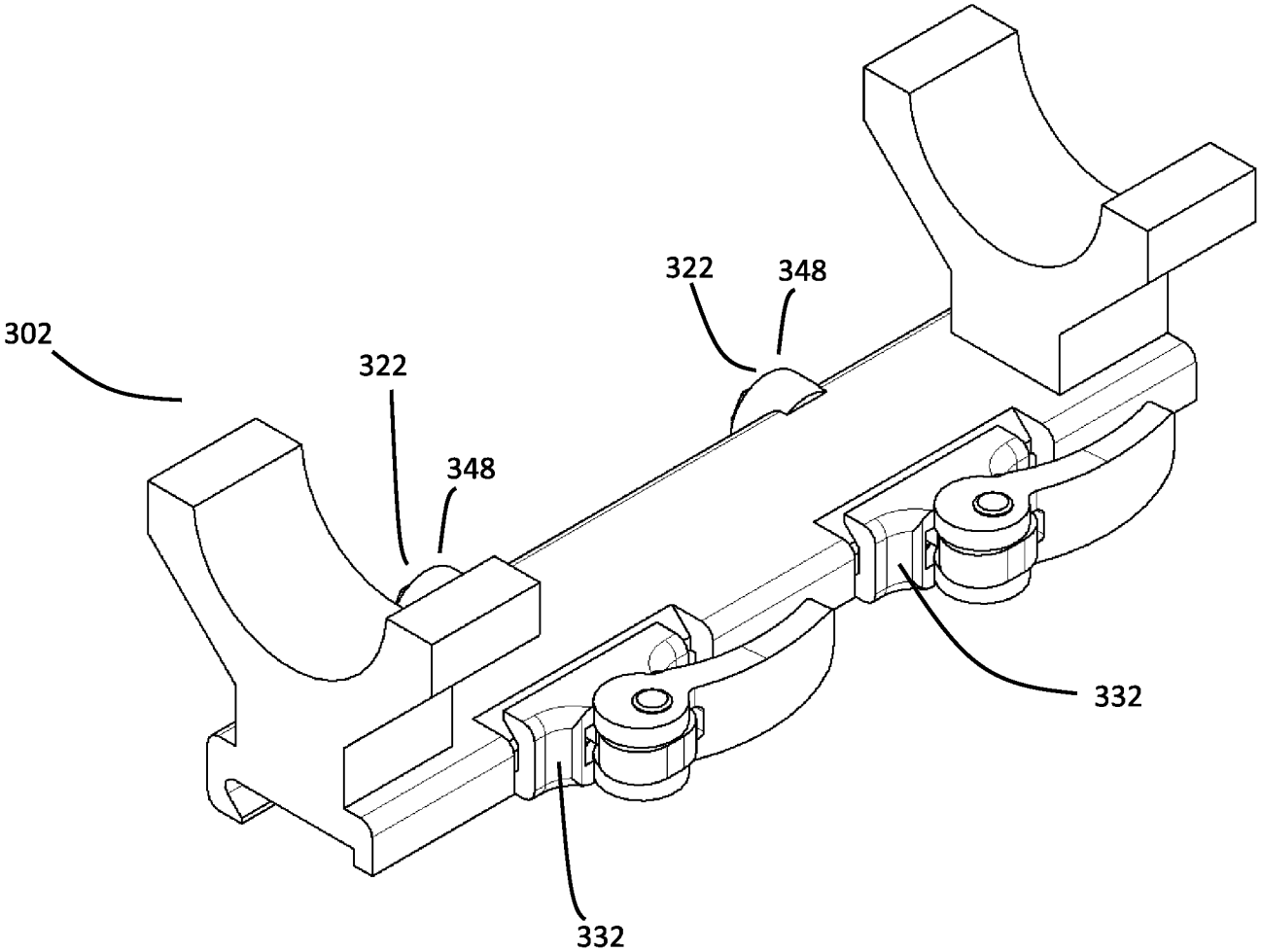
FIG. 17 is a perspective view of an alternate embodiment gun sight clamping system with two clamping bars that is to be used on longer rails where a longer sight is necessary.

In yet another embodiment, a system 302 shown in FIG. 17, two cross bars 322 are used in conjunction with two clamping bars 332. Here, as discussed above with regard to the system 202 (FIG. 16), both adjustment nuts 348 must be tightened or loosened accordingly to make an adjustment for varying rail width between guns. This configuration can be again be used with longer rails or when a longer gun sight is necessary. Some elements in FIG. 14 that are not described are similar to those of the system 2 (FIG. 6).

Figure 18:
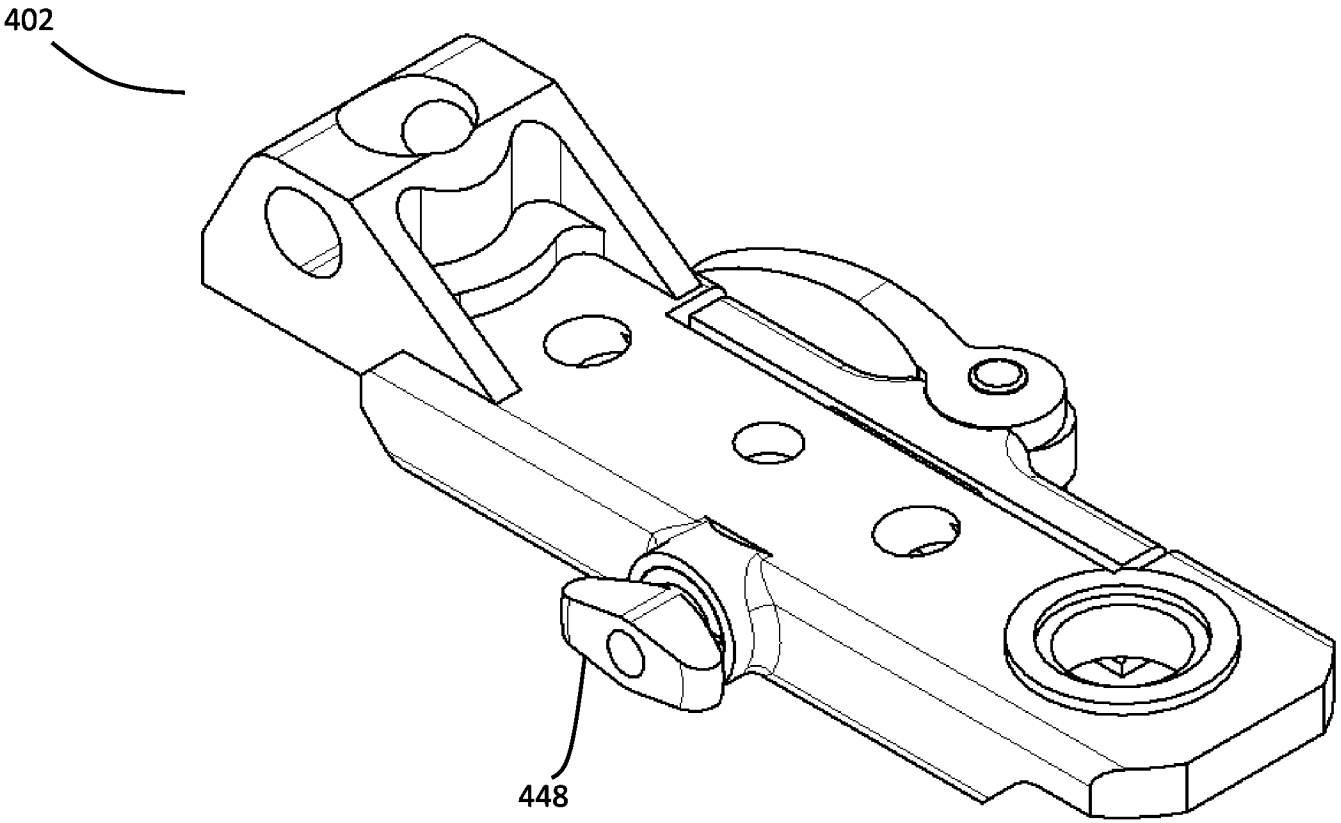
FIG. 18 is a perspective view of an alternate embodiment gun sight clamping system wherein the adjustment nut is a wing nut.

In another embodiment, a system 402 depicted in FIG. 18, the adjustment nut is a wing nut 448, or a substantially equivalent fastener, that can be appropriately tightened without the use of a tool. This embodiment provides convenience and speed to the user since adjustments to the clamping system for rail width can be performed quickly without the need of anything beyond one's own hands. This makes the clamping system more user-friendly and faster to modify. If gloves are being used, a larger style wing nut would be more desirable. Other parts of the system 402 may be similar to those discussed above with regard to other embodiments.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A gun sight clamping system comprising:

a body;

a clamping bar;

a cross bar engaging the body and the clamping bar; and a resilient device;

wherein the cross bar includes a dovetail protrusion;

wherein the body and the clamping bar have respective longitudinal inner surfaces for engaging a gun rail in a hollow defined by the inner surfaces and an underside of the body; and wherein the underside of the body includes a dovetail groove that mates with the dovetail protrusion of the cross bar as the cross bar engages the body and the clamping bar.

2. The gun sight clamping system of claim 1, wherein the resilient device provides a clamping force, in a direction that is transverse to an extent of the longitudinal inner surfaces, and from one of the longitudinal inner surfaces to the other longitudinal inner surface;

wherein the resilient device controls a clamping force by the clamping bar and the body, on the gun rail; and wherein the resilient force is controlled by a lever with an over-center cam, that engages the cross bar.

3. The gun sight clamping system of claim 1, wherein the resilient device includes one or more Belleville washers.

4. The gun sight clamping system of claim 1, wherein the resilient device is retained on the cross bar by a threaded nut.

5. The gun sight clamping system of claim 1, wherein the clamping bar engages the gun rail.

6. The gun sight clamping system of claim 1, wherein the resilient device is over a protrusion of the cross-bar that is circular in cross-section.

7. The gun sight clamping system of claim 1, wherein the resilient device is over a protrusion of the cross-bar that is non-circular in cross-section.

8. The gun clamping system of claim 1, wherein the resilient device is a coil spring or disk washer.

9. The gun sight clamping system of claim 2, wherein the lever resides on the same side of the gun rail as the clamping bar.

10. The gun sight clamping system of claim 2, wherein the lever resides on the same side of the gun rail as the body.

11. The gun clamping system of claim 2, wherein the clamping force provided by the resilient device is controlled by a cam on the lever that rotates as the lever is opened and closed.

12. The gun clamping system of claim 2, wherein a pin mechanically couples the lever to the cross bar.

13. The gun clamping system of claim 12, wherein the pin passes through a round hole in the lever, and an elongate hole cross bar, with the elongate hole acting as a slot that allows translation of the pin therewithin.

14. The gun clamping system of claim 2, wherein a rectangular portion of the cross bar is in a hole in the clamping body.

15. A gun sight clamping system comprising:

a body;

a clamping bar;

a cross bar engaging the body and the clamping bar; and a resilient device;

wherein the body and the clamping bar have respective longitudinal inner surfaces for engaging a gun rail in a hollow defined by the inner surfaces and an underside of the body;

wherein the resilient device provides a clamping force, in a direction that is transverse to an extent of the longitudinal inner surfaces, and from one of the longitudinal inner surfaces to the other longitudinal inner surface;

wherein the resilient device controls a clamping force by the clamping bar and the body, on the gun rail;

wherein a rectangular portion of the cross bar is in a hole in the clamping bar; and wherein the underside of the body includes one or more dovetail grooves that mate with one or more dovetail protrusions of the cross bar as the cross bar engages the body and the clamping bar.

16. A gun sight clamping system comprising:

a body;

a clamping bar;

a cross bar engaging the body and the clamping bar; and a resilient device;

wherein the body and the clamping bar have respective longitudinal inner surfaces for engaging a gun rail in a hollow defined by the inner surfaces and an underside of the body;

wherein the resilient device provides a clamping force, in a direction that is transverse to an extent of the longitudinal inner surfaces, and from one of the longitudinal inner surfaces to the other longitudinal inner surface;

wherein the resilient device controls a clamping force by the clamping bar and the body, on the gun rail;

wherein a rectangular portion of the cross bar is in a hole in the clamping bar; and wherein the resilient device is retained on the cross bar by a wing nut.

17. The gun clamping system of claim 15 wherein the one or more dovetail protrusions are in the rectangular portion of the cross bar.

18. A gun sight clamping system comprising:

a body;

a clamping bar;

a cross bar engaging the body and the clamping bar; and a resilient device;

wherein the body and the clamping bar have respective longitudinal inner surfaces for engaging a gun rail in a hollow defined by the inner surfaces and an underside of the body;

wherein the resilient device provides a clamping force, in a direction that is transverse to an extent of the longitudinal inner surfaces, and from one of the longitudinal inner surfaces to the other longitudinal inner surface;

wherein the resilient device controls a clamping force by the clamping bar and the body, on the gun rail;

wherein a rectangular portion of the cross bar is in a hole in the clamping bar; and wherein the underside of the body includes one or more dovetail protrusions that mate with one or more dovetail grooves of the cross bar as the cross bar engages the body and the clamping bar.

19. A gun sight clamping system comprising:

a body;

a clamping bar;

a cross bar engaging the body and the clamping bar; and a resilient device;

wherein the body and the clamping bar have respective longitudinal inner surfaces for engaging a gun rail in a hollow defined by the inner surfaces and an underside of the body;

wherein the resilient device provides a clamping force, in a direction that is transverse to an extent of the longitudinal inner surfaces, and from one of the longitudinal inner surfaces to the other longitudinal inner surface;

wherein the resilient device controls a clamping force by the clamping bar and the body, on the gun rail;

wherein a rectangular portion of the cross bar is in a hole in the clamping bar;

wherein the resilient device is retained on the cross bar by a threaded nut;

wherein the nut is an adjustment nut; and further comprising a retainer connected to the body, wherein the retainer fits over and protects the adjustment nut.

* * * * *